US005428852A

United States Patent [19]

Tenuta et al.

[11] Patent Number: 5,428,852

[45] Date of Patent: Jul. 4, 1995

[54] MATTRESS AND PILLOWTOP ASSEMBLY

[75] Inventors: David Tenuta, Upland; Jose G. Alvarez, Walnut, both of Calif.

[73] Assignee: Angel Echevarria Co., Inc., Los Angeles, Calif.

[21] Appl. No.: 230,216

[22] Filed: Apr. 20, 1994

[51] Int. Cl.[6] ..... A47C 27/00

[52] U.S. Cl. ..... 5/448; 5/465; 5/466; 5/903

[58] Field of Search ..... 5/465, 466, 500, 501, 5/903, 922, 448, 484, 487

[56] References Cited

U.S. PATENT DOCUMENTS

| | | | |
|---|---|---|---|
| 1,596,209 | 8/1926 | Mulkey | 5/466 |
| 1,709,995 | 4/1929 | Mulkey | 5/466 X |
| 1,892,913 | 1/1933 | Timm . | |
| 2,099,427 | 11/1937 | Karr | 5/500 |
| 2,210,210 | 8/1940 | Kisilew . | |
| 2,610,336 | 9/1952 | Schworm, Jr. . | |
| 2,620,494 | 12/1952 | Kay . | |
| 2,630,587 | 3/1953 | Brown | 5/466 X |
| 2,821,723 | 4/1958 | Gluck . | |
| 2,924,833 | 2/1960 | Klogether . | |
| 3,008,152 | 11/1961 | Seidenberg . | |
| 3,626,525 | 12/1971 | Fasanella | 5/466 |
| 3,842,455 | 10/1974 | Whitney | 5/903 X |
| 4,336,621 | 6/1982 | Schwartz et al. | 5/903 X |
| 4,955,095 | 9/1990 | Gerrick . | |
| 5,117,519 | 6/1992 | Thomas | 5/903 X |

*Primary Examiner*—Michael F. Trettel
*Attorney, Agent, or Firm*—Henry M. Bissell

[57] ABSTRACT

A mattress and pillowtop assembly includes a reversible, invertible mattress which may have a generally horizontal top and with generally vertical sides extending between the top and bottom to define a central space containing supporting and cushioning components. The mattress also includes a number of spaced, generally vertically extending straps, the opposite ends of which are connected to the exterior of the sides of the mattress adjacent the top and bottom. The straps are used in lifting, turning and inverting the mattress to extend its utility. A pillowtop extends over the top of the mattress, releasably held in place by two sets of connectors. The first set comprises a number of spaced connectors anchored to the periphery of the pillowtop and extending outwardly therefrom. The second set comprises an equal number of spaced rings slidably mounted on the lifting straps for easy movement between the mattress top and bottom. The rings preferably bear T-shaped fittings while the first set of connectors preferably bear generally U-shaped fittings releasably engageable with the T-shaped fittings. When the mattress is to be inverted, the first and second sets of connectors are disengaged from each other, the pillowtop is removed and the mattress is then inverted, after which the pillowtop is reconnected through the connector sets to the surface of the mattress which is now the top.

9 Claims, 1 Drawing Sheet

MATTRESS AND PILLOWTOP ASSEMBLY

BACKGROUND OF THE INVENTION

1. Field of the Invention

This invention relates to weight-supporting bed components and, more particularly, to an improved mattress and pillowtop assembly.

2. Description of the Related Art

Modern bed assemblies usually comprise a bed frame, a set of support springs, preferably enclosed in a container and referred to as box springs, and a mattress. The box springs rest on the frame with the mattress resting on top of the box springs. The mattress extends substantially the length and width of the bed and is of substantial thickness, being composed of supporting and cushioning components.

Certain inventions have been directed to the protection of the mattress. See, for example, U.S. Pat. Nos. 2,210,210, 2,620,494, 2,924,833, 3,008,152 and 2,610,336 directed, respectively, to covering sheets for mattresses, absorbent protective pads, mattress draw sheets, bed clothing covers, and mattress protectors. Such devices are designed to extend the useful life of the mattress, protecting it from soiling.

Certain of such mattresses can be reversed, that is, turned from end to end and also turned over so that the bottom of the mattress is in the top position. This is particularly useful to counteract mattress sagging from the continued weight of the sleepers in one position. Most mattresses are heavy, however, and somewhat difficult to turn and invert. For this reason, handles are often provided along the sides and/or ends of the mattress for use in turning the mattress.

Pillowtops have been used to further extend the useful life of the mattress. A pillowtop is usually a relatively thin but cushioned bedding component substantially coextensive with the length and width of the mattress and adapted to rest on the upper surface of the mattress. The pillowtop protects the mattress from soiling, usually can be removed and cleaned and reused, and provides additional bed cushioning. One such pillowtop is described in U.S. Pat. No. 4,955,095. Pillowtops are commonly attached to the mattress, as by hook and loop fasteners sold under the trademark Velcro, zippers, buttons and the like. These fasteners must be provided on both sides of the mattress so that the pillowtop may be attached or re-attached after the mattress is turned over.

In view of the advantageous characteristics of pillowtops, it would be desirable to be able to provide an improved mattress and pillowtop assembly which would permit the mattress to be easily reversed, that is, inverted, and would also permit the pillowtop to be easily releasably attached to the mattress when the latter is in either the normal or the inverted position.

SUMMARY OF THE INVENTION

The improved mattress and pillowtop assembly of the present invention satisfies all the foregoing needs. The assembly is substantially as set forth in the Abstract of the Disclosure. Thus, the assembly comprises a mattress of conventional construction having a preferably generally horizontal top, a preferably generally horizontal bottom spaced below the top and preferably generally vertical sides interconnecting the top and bottom and defining therewith a closed space containing weight-supporting and cushioning components. The mattress includes a plurality of spaced, preferably generally vertically extending lifting straps, the opposite ends of which are attached to the exterior surfaces of the mattress sides adjacent the mattress top and bottom. The straps make it easy to lift, turn and invert the mattress to extend its useful life.

The assembly also includes a pillowtop extending over and resting on the mattress and two sets of connectors releasably connecting the pillowtop to the mattress. The first set comprises a plurality of elongated, spaced flexible connectors anchored to the periphery of the pillowtop and extending outwardly therefrom. The second set of connectors comprises a plurality of spaced rings, each ring being slidably mounted on a separate one of the lifting straps, for easy movement of the rings between the ends of the straps, that is, between the mattress top and bottom.

The rings preferably bear T-shaped fittings projecting therefrom for releasable engagement with preferably generally U-shaped fittings on the free ends of the first set of connectors. With this arrangement, not only can the pillowtop be easily connected to and disconnected from the mattress top, but the pillowtop can just as easily be releasably attached to the mattress bottom when the mattress is inverted, since the rings easily slide on the lifting straps to a position where such easy attachment to the first set of connectors can readily occur.

Various other features of the assembly of the present invention are set forth in the following detailed description and accompanying drawings.

BRIEF DESCRIPTION OF THE DRAWING

A better understanding of the present invention may be realized from a consideration of the following detailed description, taken in conjunction with the accompanying drawing, in which.

DETAILED DESCRIPTION OF THE PREFERRED EMBODIMENTS

FIGS. 1–5

Now referring more particularly to FIGS. 1–5 of the drawings, a preferred embodiment of the improved reversible mattress-pillowtop assembly of the present invention is schematically depicted therein.

Figure 1:
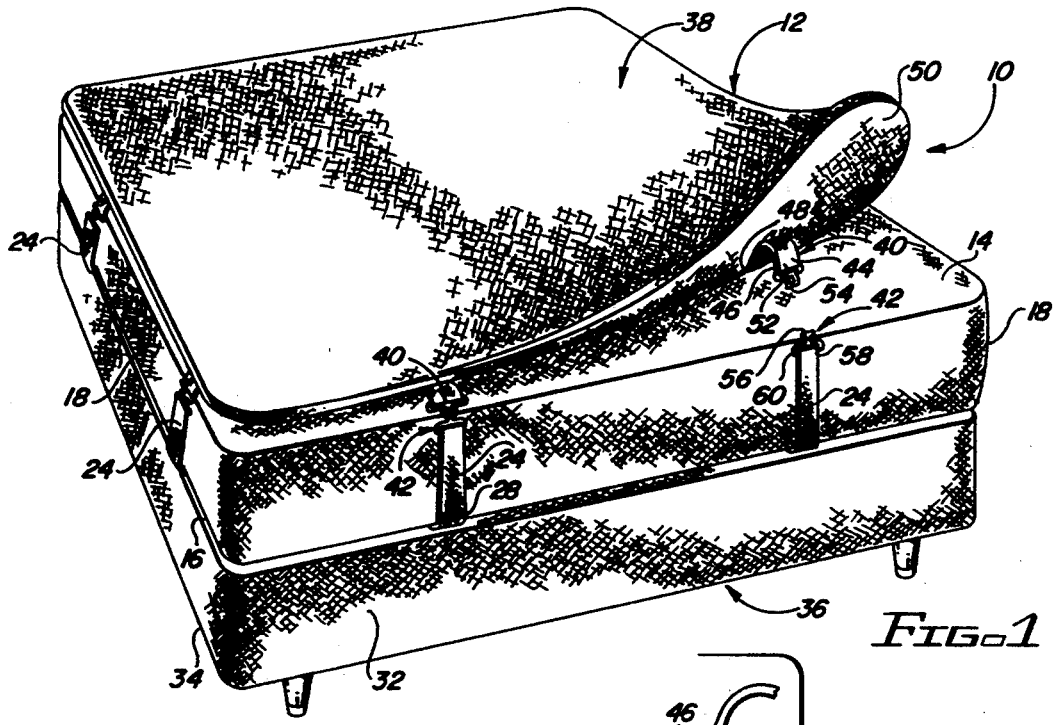
FIG. 1 is a schematic perspective view of a preferred embodiment of the improved reversible mattress and pillowtop assembly of the present invention, shown disposed on a bed frame and with one edge of the pillowtop lifted up for viewing of the first set of connectors of the assembly.
Figure 2:
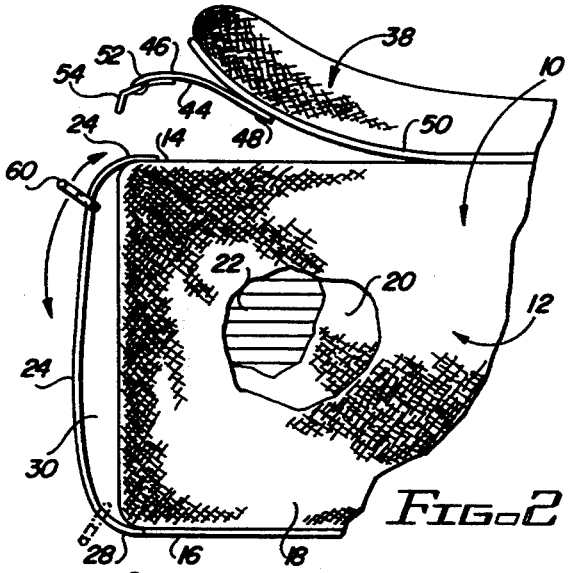
FIG. 2 is an enlarged, fragmentary schematic side elevation, partly broken away, of the assembly of FIG. 1.
Figure 5:
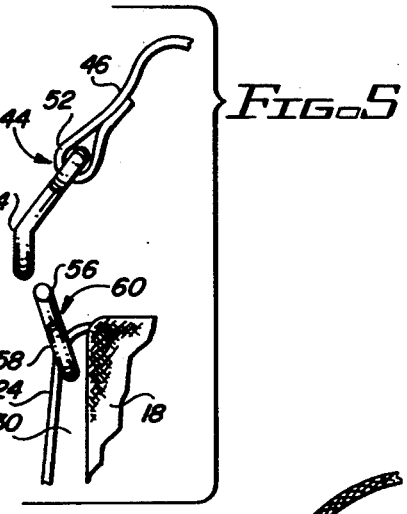
FIG. 5 is an enlarged, fragmentary schematic side elevation of the connectors of FIG. 3.

Thus, assembly 10 is shown which comprises a reversible mattress 12 having a preferably horizontal top 14 of extended surface area, a preferably horizontal bottom 16 of the same area as the top and spaced therebelow, and preferably vertical sides 18 interconnecting bottom 16 and top 14 to define therewith a closed central space 20 containing cushioning and weight-supporting means 22 (FIG. 2). Although mattress 12 is shown in FIG. 1 as being a generally rectangular box, it will be understood that it could be circular, oval or another shape in plan view and could have contoured rather than flat upper and lower surfaces, if desired.

Mattress 12 includes a plurality of spaced, preferably generally vertical lifting straps 24, the opposite ends 26 and 28 of which are attached to the exterior of sides 18 adjacent top 14 and bottom 16, as shown in FIGS. 1 and 2. Straps 24 enable mattress to be easily lifted and reversed head to foot and to be easily flipped over, that is inverted, so that bottom 16 becomes the upper surface of mattress 12. This is customarily done on a regular basis in order to extend the useful life of mattress 12 by distributing its wear to both top 14 and bottom 16. As can be seen in FIG. 2, a gap 30 is provided between strap 24 and side 18 to enable a hand to be inserted behind strap 24 to facilitate such lifting, turning and inverting of mattress 12 as described above.

FIG. 1 shows mattress 12 resting on the top of box springs 32 which are supported on a frame 34 of a bed 36. To top 14 of mattress 12 is releasably secured a relatively thin pillowtop 38 which is substantially coextensive with the length and width of mattress 12 and which contains cushioning and padding (not shown). Pillowtop 38 protects mattress 12 from soiling and renders it softer and more comfortable to sleep upon.

Pillowtop 38 is releasably connected to mattress 12 by two sets of connectors, that is, connector sets 40 and 42. Connector set 40 comprises a plurality of spaced connectors 44, each comprising an elongated flexible strap 46 of cloth, plastic, leather or the like, one end 48 of which is anchored, as by stitching, to the underside 50 of pillowtop 38 adjacent the outer periphery of pillowtop 38, and the opposite free end 52 of which strap 46 extends outwardly from pillowtop 38, as shown in FIG. 1.

Preferably, free end 52 of strap 46 bears a bent or cast generally U-shaped fitting 54 which releasably connects to a generally T-shaped fitting 56 connected to a ring 58 slidably disposed around strap 24. Ring 58 and fitting 56 comprise a connector 60, a plurality of which form the second set 42 of connectors. Ring 58 of connector 60 is dimensioned to readily slide between opposite ends 26 and 28 of strap 24 so that ring 58 can be used as a connector means whether mattress 12 is in inverted or non-inverted (normal) position. This is illustrated by the phantom outline of connector 60 near the lower end 28 in FIG. 2. Thus, pillowtop 38 can be easily connected to and disconnected from mattress 12, whether mattress 12 is inverted or not. It will be understood that the lifting straps 24 are provided on both sides and opposed ends of the mattress 12 and that a connector 60 is slidably installed on each lifting strap 24 in the manner shown and described hereinabove. Thus the pillowtop 38 is secured in place on all sides when the connectors 40 and 42 are coupled together all around. Furthermore, the arrangement of the fittings may be reversed, if desired, with the U-shaped fitting 54 being attached to the slidable ring 58 and the T-shaped fitting 56 being mounted on the free end 52 of the strap 46. Other types of connectors may be utilized as well so long as one part of the connector includes a ring portion which can be slidably mounted on the vertically oriented lifting straps and the other part accommodates attachment to a corresponding strap of the pillowtop, both parts being readily attachable and releasable under control of the user.

Figure 3:
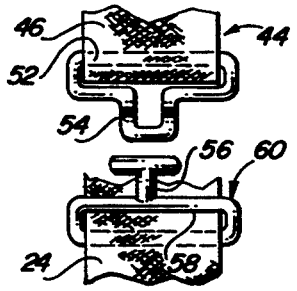
FIG. 3 is an enlarged, fragmentary schematic front elevation of one of the connectors of the first set and one of the connectors of the second set of the assembly of FIG. 1, shown in the approximated but disengaged position.
Figure 4:
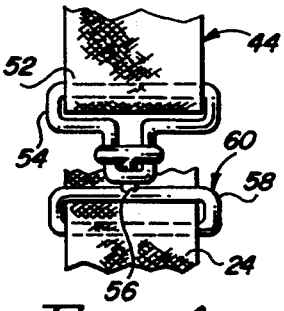
FIG. 4 is an enlarged, fragmentary schematic front elevation of the connectors of FIG. 3 in the releasably engaged position.

The particular manner of releasable connection of fittings 54 and 56 is detailed in FIGS. 3 and 4. Since strap 46 is flexible, it can be twisted to releasably engage fitting 54 over and around fitting 56 to releasably anchor connectors 44 and 60 together and thus hold pillowtop 38 against mattress 12 to prevent slippage therebetween. This releasable connection is afforded whether mattress 12 is inverted or not. It will be understood that pillowtop 38 normally is first disengaged from mattress 12 before mattress 12 is inverted and then is re-engaged therewith after the inverting has been completed, so that pillowtop 38 always is on the upper surface of mattress 12.

Accordingly, pillowtop 38 and mattress 12 are easily maneuverable for optimal utility and convenience. Assembly 10 is simple, inexpensive, durable and highly efficient.

FIG. 6

Figure 6:
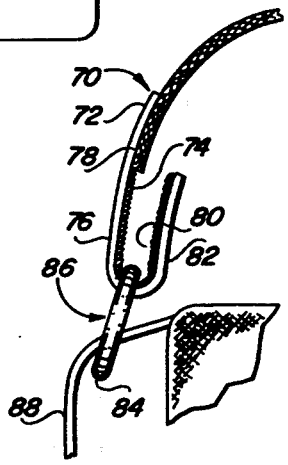
FIG. 6 is an enlarged, fragmentary schematic side elevation of a modified version of one of the first set of connectors releasably engaged with one of the second set of connectors of the assembly of the present invention.

A modified version of the connectors used in releasably connecting pillowtop 38 to mattress 12 is schematically depicted in FIG. 6. Thus, connector 70 is shown. It can be substituted for one or more of connectors 44 in set 40, if desired. Connector 70 comprises a flexible elongated strap 72 which bears hook and loop-type receptor hooks 74 on one surface 76 thereof adjacent the upper end 78 thereof and hook and loop-type loops 80 on the same surface thereof but adjacent the opposite end 82 thereof.

Strap 72 can merely be looped through ring 84 which is like the ring 58 but without the T-shaped extension 56, serves as connector 86 and which is slidably received on lifting strap 88, strap 88 being substantially identical to strap 24. Strap 72 can then be reflected back on itself to releasably engage hooks 74 and loops 76. It will be noted that the U-shaped and T-shaped fittings previously described for connector sets 40 and 42 are absent from this connector array.

Although there have been described hereinabove various specific arrangements of an improved mattress and pillowtop assembly in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. An improved reversible mattress and pillowtop assembly, said assembly comprising, in combination:

a reversible and invertible mattress having a top, a bottom spaced below said top and spaced sides interconnecting said top and bottom, said mattress including a plurality of spaced lifting straps connected to the exterior of said sides adjacent said top and bottom, said straps serving as means for lifting, turning, reversing and inverting said mattress;

a pillowtop extending over and resting on said mattress top;

a plurality of spaced first connector means anchored to said pillowtop adjacent the outer periphery thereof and extending outwardly therefrom; and a plurality of spaced second connector means slidably mounted on said lifting straps and moveable along the straps between said top and bottom, said first connector means being releasably connectable with said second connector means to releasably secure said pillowtop to said mattress, said first and second connector means permitting said pillowtop to be releasably connected to said mattress bottom when said mattress is inverted so that its bottom is in the top position.

2. The reversible mattress and pillowtop assembly of claim 1 wherein said mattress includes a central space having weight-supporting and cushioning means, wherein said pillowtop includes cushioning means and is substantially co-extensive with said mattress and wherein said mattress top and bottom are generally horizontal in use and said mattress sides and lifting straps are generally vertically oriented.

3. The reversible mattress and pillowtop assembly of claim 1 wherein each of said second connector means includes a ring slidably disposed around one of said lifting straps for easy movement between said mattress top and bottom.

4. The reversible mattress and pillowtop assembly of claim 3 wherein said ring bears a projecting generally T-shaped fitting and wherein each of said first connector means comprises a flexible strap which includes adjacent its free end a generally U-shaped projecting tongue adapted to be releasably engaged around said T-shaped fitting.

5. The reversible mattress and pillowtop assembly of claim 1 wherein each of said first connector means comprises a connecting strap having hook and loop portions releasably connectable together to form a closed loop and wherein each of said second connector means comprises a ring slidably disposed around a corresponding lifting strap and adapted to releasably receive said connecting strap to releasably secure said pillowtop to said mattress.

6. A mattress assembly comprising:

a top and bottom with sides extending between the top and bottom;

a plurality of lifting straps secured at upper and lower ends to the sides of the mattress; and a plurality of first fasteners mounted for sliding movement along corresponding ones of said lifting straps to attach to an object placed on the mattress top, the fasteners being slidable from one end toward the other end of the lifting straps for attachment to an object placed on the bottom of the mattress when the mattress is in an inverted position.

7. The mattress assembly of claim 6 further comprising a pillowtop having a plurality of second fasteners secured adjacent the outer periphery of the pillowtop in positions corresponding to the positions of the lifting straps of the mattress, each of said second fasteners being configured to releasably engage one of said first fasteners for releasably coupling the pillowtop to the mattress.

8. The mattress assembly of claim 7 wherein the second fasteners are attached to the pillowtop by flexible straps which permit manipulation of the second fasteners into positions to engage the corresponding first fasteners.

9. The mattress assembly of claim 8 wherein one of said first and second fasteners includes a T-shaped connector fitting and the other of said first and second fasteners includes an encircling loop fitting for receiving and releasably retaining the T-shaped fitting therein.

* * * * *